US006427337B1

(12) United States Patent
Burks

(10) Patent No.: US 6,427,337 B1
(45) Date of Patent: Aug. 6, 2002

(54) HAIR CUTTING DEVICE

(76) Inventor: James A. Burks, 159 Nathan Loop, Ruston, LA (US) 71270

( * ) Notice: Subject to any disclaimer, the term of this patent is extended or adjusted under 35 U.S.C. 154(b) by 41 days.

(21) Appl. No.: 09/641,850

(22) Filed: Aug. 18, 2000

(51) Int. Cl.[7] ..... B26B 19/02; B26B 19/20

(52) U.S. Cl. ..... 30/200; 30/201; 30/210; 30/223; 30/233.5

(58) Field of Search ..... 30/200, 201, 210, 30/223, 233.5; D28/52, 53, 54

(56) References Cited

U.S. PATENT DOCUMENTS

| | | | | | |
|---|---|---|---|---|---|
| 159,004 | A | * | 1/1875 | Wilkins | 30/200 |
| 221,087 | A | * | 10/1879 | Miller | 30/201 |
| 402,727 | A | * | 5/1889 | Eisenhuth | 30/201 |
| 1,489,198 | A | * | 4/1924 | Vincenti | 30/201 |
| 2,174,130 | A | * | 9/1939 | Looper | 30/223 |
| 2,381,046 | A | * | 8/1945 | Giorgi | 30/201 |
| D169,108 | S | * | 3/1953 | Sekerdy | D28/54 |
| 2,713,718 | A | * | 7/1955 | Hudson | 30/200 |
| 3,646,675 | A | | 3/1972 | Wezel | |
| 3,648,370 | A | * | 3/1972 | Cercone | 30/201 |
| 3,805,136 | A | | 4/1974 | Meyer et al. | |
| 4,214,365 | A | | 7/1980 | Walter et al. | |
| 4,221,050 | A | | 9/1980 | Walter et al. | |
| D260,562 | S | | 9/1981 | Mack et al. | |
| 4,498,237 | A | * | 2/1985 | Mack et al. | 30/200 |
| 5,325,590 | A | | 7/1994 | Andis et al. | |

* cited by examiner

*Primary Examiner*—Allan N. Shoap
*Assistant Examiner*—Stephen Choi

(57) ABSTRACT

A hair cutting device for providing the user with greater control when trimming around person's neck, ears, and forehead. The hair cutting device includes an elongate housing having a front end and a back end; and also includes a cutting assembly including a cutting head assembly being movably attached to the front end of the elongate housing; and further includes cutting head attachments being removably mounted to the cutting head assembly.

9 Claims, 2 Drawing Sheets

HAIR CUTTING DEVICE

BACKGROUND OF THE INVENTION

1. Field of the Invention

The present invention relates to a hair trimmer and clipper and more particularly pertains to a new hair cutting device for providing the user with greater control when trimming around person's neck, ears, and forehead.

2. Description of the Prior Art

The use of a hair trimmer and clipper is known in the prior art. More specifically, a hair trimmer and clipper heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,221,050; 3,805,136; U.S. Pat. No. Des. 260,562; U.S. Pat. Nos. 3,646,675; 5,325,590; and 4,214,365.

While these devices fulfill their respective, particular objectives and requirements, the aforementioned patents do not disclose a new hair cutting device. The inventive device includes an elongate housing having a front end and a back end; and also includes a cutting assembly including a cutting head assembly being movably attached to the front end of the elongate housing; and further includes cutting head attachments being removably mounted to the cutting head assembly.

In these respects, the hair cutting device according to the present invention substantially departs from the conventional concepts and designs of the prior art, and in so doing provides an apparatus primarily developed for the purpose of providing the user with greater control when trimming around person's neck, ears, and forehead.

SUMMARY OF THE INVENTION

In view of the foregoing disadvantages inherent in the known types of hair trimmer and clipper now present in the prior art, the present invention provides a new hair cutting device construction wherein the same can be utilized for providing the user with greater control when trimming around person's neck, ears, and forehead.

The general purpose of the present invention, which will be described subsequently in greater detail, is to provide a new hair cutting device which has many of the advantages of the hair trimmer and clipper mentioned heretofore and many novel features that result in a new hair cutting device which is not anticipated, rendered obvious, suggested, or even implied by any of the prior art hair trimmer and clipper, either alone or in any combination thereof.

To attain this, the present invention generally comprises an elongate housing having a front end and a back end; and also includes a cutting assembly including a cutting head assembly being movably attached to the front end of the elongate housing; and further includes cutting head attachments being removably mounted to the cutting head assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair cutting device which has many of the advantages of the hair trimmer and clipper mentioned heretofore and many novel features that result in a new hair cutting device which is not anticipated, rendered obvious, suggested, or even implied by any of the prior art hair trimmer and clipper, either alone or in any combination thereof.

It is another object of the present invention to provide a new hair cutting device which may be easily and efficiently manufactured and marketed.

It is a further object of the present invention to provide a new hair cutting device which is of a durable and reliable construction.

An even further object of the present invention is to provide a new hair cutting device which is susceptible of a low cost of manufacture with regard to both materials and labor, and which accordingly is then susceptible of low prices of sale to the consuming public, thereby making such hair cutting device economically available to the buying public.

Still yet another object of the present invention is to provide a new hair cutting device which provides in the apparatuses and methods of the prior art some of the advantages thereof, while simultaneously overcoming some of the disadvantages normally associated therewith.

Still another object of the present invention is to provide a new hair cutting device for providing the user with greater control when trimming around person's neck, ears, and forehead.

Yet another object of the present invention is to provide a new hair cutting device which includes an elongate housing having a front end and a back end; and also includes a cutting assembly including a cutting head assembly being movably attached to the front end of the elongate housing; and further includes cutting head attachments being removably mounted to the cutting head assembly.

Still yet another object of the present invention is to provide a new hair cutting device that also effectively shaves portions of a person's hair after the person's hair is cut with this same device.

Even still another object of the present invention is to provide a new hair cutting device that provides the user with greater accuracy and maneuverability while trimming another person's hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
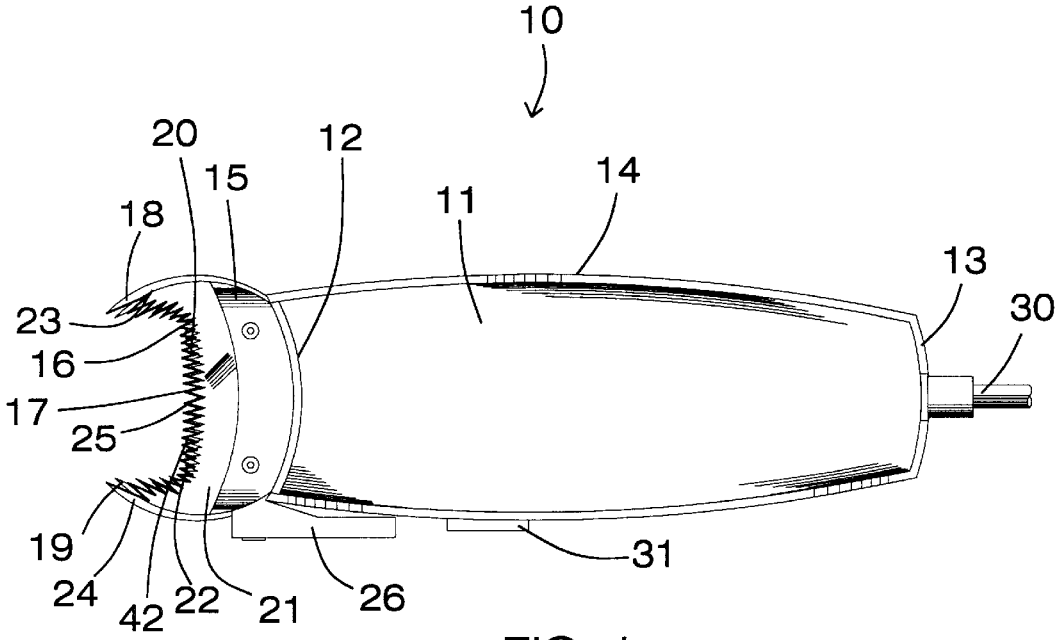
FIG. 1 is a top plan view of a new hair cutting device according to the present invention.
Figure 2:
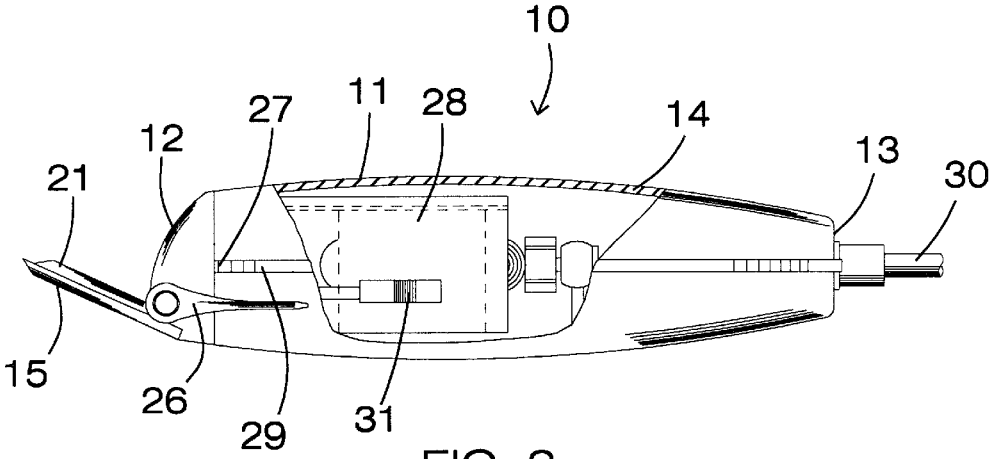
FIG. 2 is a partial cross-sectional view of the present invention.
Figure 3:
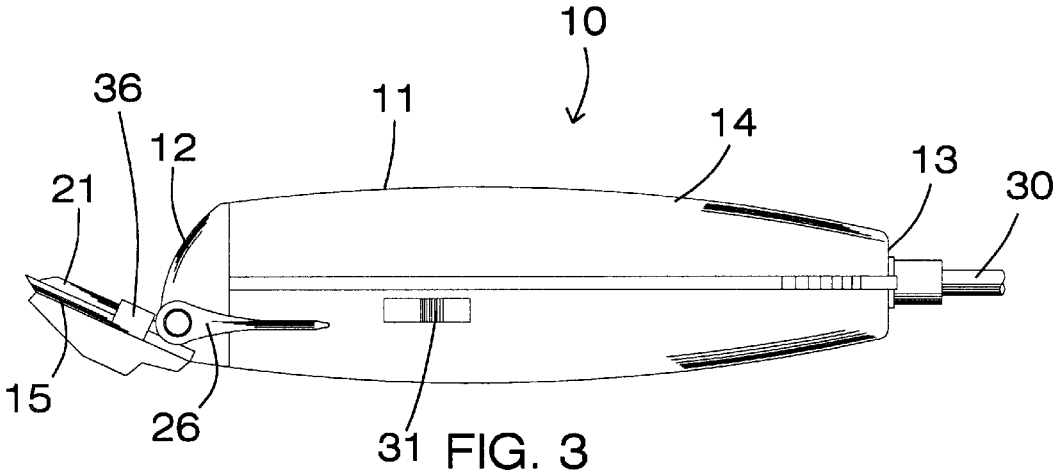
FIG. 3 is a side elevational view of the present invention.
Figure 4:
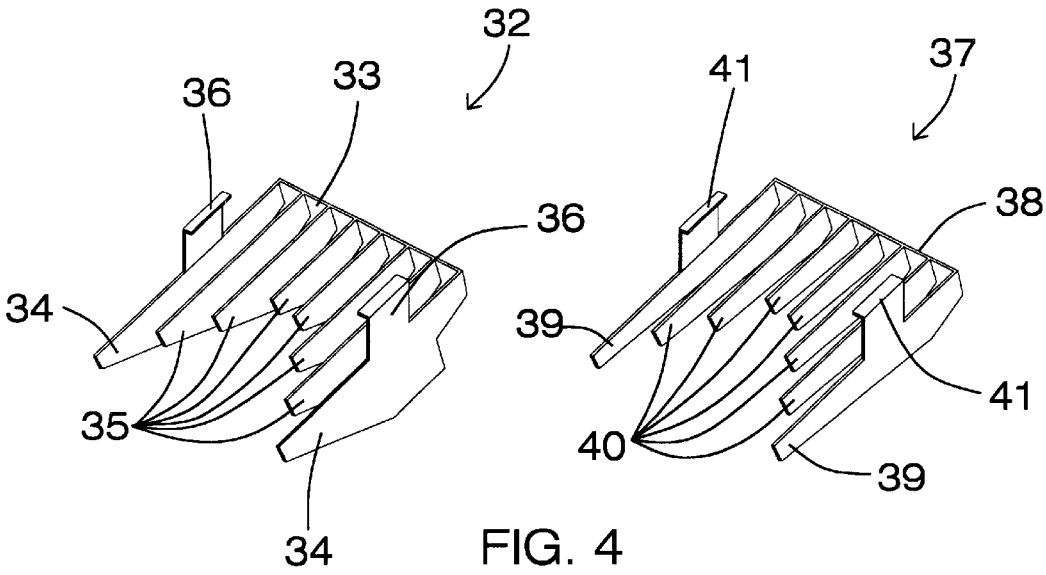
FIG. 4 is a perspective view of the present invention showing, in particular, the cutting head attachments.

With reference now to the drawings, and in particular to FIGS. 1 through 4 thereof, a new hair cutting device embodying the principles and concepts of the present invention and generally designated by the reference numeral 10 will be described.

As best illustrated in FIGS. 1 through 4, the hair cutting device 10 generally comprises an elongate housing 11 having a front end 12 and a back end 13. A cutting assembly includes a cutting head assembly being movably and conventionally attached to the front end 12 of the elongate housing 11 with the cutting assembly also including a cutting support member 15 being securely and conventionally attached to the front end 12 of the elongate housing 11, and also including a cutting member 21 being movably and conventionally mounted to the cutting support member 15, and further including a lever 26 being pivotally and conventionally attached to the cutting member 21 for adjustably moving the cutting member 21 relative to the cutting support member 15, and also including a conventional oscillator member 27 being securely and conventionally attached to the cutting member 21 and being disposed in the elongate housing 11 for moving said cutting member 21 back and forth, and further including a motor 28 being disposed in the elongate housing 11 and having a shaft 29 conventionally connected to the oscillator member 27, and also including a power source 30 conventionally connected to the motor 28 for the energizing thereof, and further including an on/off switch 31 movably and conventionally mounted to a wall 14 of the elongate housing 11 and being conventionally connected to the power source 30 and to the motor 28. The cutting support member 15 includes a front edge 16 which has a main portion 17 and end portions 18,19 integrally connected and angled relative to the main portion 18 with the front edge 16 further including a plurality of teeth 20 securely disposed along a length thereof. The end portions 18,19 extend forwardly of the main portion 17 with each of the end portions 18,19 essentially having a pointed end. The cutting member 21 includes a cutting edge 42 having a main portion 22 and end portions 23,24 integrally connected and angled relative to the main portion 22 with the cutting edge 42 also having a plurality of teeth 25 disposed along a length thereof and with each of the end portions 23,24 having a pointed end. The front edge 16 of the cutting support member 15 and the cutting edge 42 of the cutting member 21 are essentially U-shaped as viewed from a top of the cutting support member 15 and the cutting member 21. The power source 30 includes a power cord extending through the back end 13 of the elongate housing 11 and being connected to the motor 28.

Cutting head attachments 32,37 are removably mounted to the cutting head assembly with the cutting head attachments 32,37 including first and second cutting head attachments 32,37 each having a support member 33,38 and also having a plurality of elongate guide members 34,35,39,40 being spaced apart and being integrally disposed along a length of the support member 33,38 and extending generally perpendicular to the support member 33,38 and further having clip members 36,41 securely and conventionally attached to end guide members 34,39 and being adapted to clip onto the cutting support member 15 over the cutting member 15 to control the length of hair to be cut off. The elongate guide members 34,35,39,40 include the end guide members 34,39 and also include intermediate guide members 35,40 which are disposed between the end guide members 34,39 with the end guide members 34,39 being longer than the intermediate guide members 35,40 and with the intermediate guide members 35,40 being gradually shorter moving from the end guide members 34,39 toward a center of the support member 33,38. The elongate guide members 34,35,39,40 have front edges which essentially form a U-shape. The end guide members 34 of the first cutting head attachment 32 have a greater width than the end guide members 39 of the second cutting head attachment 37 with the first cutting head attachment 32 being adapted to cut hair longer and the second cutting head attachment 37 being adapted to cut hair shorter.

In use, the user attaches whichever cutting head attachment 32,37 to the cutting support member 15 and turns on the on/off switch 31 to energize the motor 28 which, in turn, drives the oscillator member 27 to move the cutting member 21 back and forth relative to the cutting support member 21. The user then uses the hair cutting device 10 to cut another person's hair including carefully trimming around the person's ear, neck, and forehead.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A hair cutting device comprising:

an elongate housing having a front end and a back end;

a cutting assembly including:

a cutting support member immovably mounted on said front end of said elongate housing, said cutting support member including a front edge which has a main portion and end portions integrally connected and angled relative to said main portion, a plurality of teeth being formed on the main and end portions of said front edge, each of said teeth having a tip;

a cutting member being movably mounted on said cutting support member, said cutting member including a cutting edge having a main portion and end portions integrally connected and angled relative to said main portion, a plurality of teeth being formed on the main and end portions of said cutting edge, each of said teeth having a tip; and cutting head attachments for interchangeable mounting on said cutting support member;

wherein said front edge of said cutting support member and said cutting edge of said cutting member are substantially U-shaped as viewed from a top of said cutting support member and said cutting member, the tips on the teeth of each of said end portions being positioned substantially on a line and the tips of the teeth on each of said main portions being positioned substantially on a line, the lines defined by the tips of said teeth on said end portions being oriented substantially perpendicular to the lines defined by the tips of the teeth of the main portions.

2. A hair cutting device as described in claim 1, wherein said cutting assembly includes:

an oscillator member attached to said cutting member and being disposed in said elongate housing;

a motor being disposed in said elongate housing and having a shaft connected to said oscillator member;

a power source connected to said motor for the energizing thereof; and an on/off switch movably mounted to a wall of said elongate housing and being connected to said power source and to said motor.

3. A hair cutting device as described in claim 2, wherein said power source includes a power cord extending through said back end of said elongate housing and being connected to said motor.

4. A hair cutting device as described in claim 1, wherein each of said end portions of said cutting support member have a pointed end.

5. A hair cutting device as described in claim 4, wherein each of said end portions of said cutting member have a pointed end.

6. A hair cutting device as described in claim 1, wherein said cutting head attachments include first and second cutting head attachments each having a support member and also having a plurality of elongate guide members being spaced apart and being disposed along a length of said support member and extending generally perpendicular to said support member and further having clip members securely attached to end guide members and being adapted to clip onto said cutting support member over said cutting member to control the length of hair to be cut off.

7. A hair cutting device as described in claim 6, wherein said elongate guide members include said end guide members and also include intermediate guide members which are disposed between said end guide members, said end guide members being longer than said intermediate guide members with said intermediate guide members being gradually shorter moving from said end guide members toward a center of said support member, said elongate guide members having front edges which essentially form a U-shape.

8. A hair cutting device as described in claim 6, wherein said end guide members of said first cutting head attachment have a greater width than said end guide members of said second cutting head attachment, said first cutting head attachment being adapted to cut hair longer and said second cutting head attachment being adapted to cut hair shorter.

9. A hair cutting device comprising:

an elongate housing having a front end and a back end;

a cutting assembly including:

a cutting support member immovably mounted on said front end of said elongate housing, said cutting support member including a front edge which has a main portion and end portions integrally connected and angled relative to said main portion, a plurality of teeth being formed on the main and end portions of said front edge, each of said teeth having a tip;

a cutting member being movably mounted on said cutting support member, said cutting member including a cutting edge having a main portion and end portions integrally connected and angled relative to said main portion, a plurality of teeth being formed on the main and end portions of said cutting edge, each of said teeth having a tip; and cutting head attachments for interchangeable mounting on said cutting support member;

wherein said front edge of said cutting support member and said cutting edge of said cutting member are substantially U-shaped as viewed from a top of said cutting support member and said cutting member, the tips on the teeth of each of said end portions being positioned substantially on a line and the tips of the teeth on each of said main portions being positioned substantially on a line, the lines defined by the tips of said teeth on said end portions being oriented substantially perpendicular to the lines defined by the tips of the teeth of the main portions;

wherein said cutting assembly includes:

an oscillator member attached to said cutting member and being disposed in said elongate housing;

a motor being disposed in said elongate housing and having a shaft connected to said oscillator member;

a power source connected to said motor for the energizing thereof; and an on/off switch movably mounted to a wall of said elongate housing and being connected to said power source and to said motor;

wherein each of said end portions of said cutting support member have a pointed end;

wherein each of said end portions of said cutting member have a pointed end;

wherein said power source includes a power cord extending through said back end of said elongate housing and being connected to said motor;

wherein said cutting head attachments include first and second cutting head attachments each having a support member and also having a plurality of elongate guide members being spaced apart and being disposed along a length of said support member and extending generally perpendicular to said support member and further having clip members securely attached to end guide members and being adapted to clip onto said cutting support member over said cutting member to control the length of hair to be cut off;

wherein said elongate guide members include said end guide members and also include intermediate guide members which are disposed between said end guide members, said end guide members being longer than said intermediate guide members with said intermediate guide members being gradually shorter moving from said end guide members toward a center of said support member, said elongate guide members having front edges which essentially form a U-shape; and wherein said end guide members of said first cutting head attachment have a greater width than said end guide members of said second cutting head attachment, said first cutting head attachment being adapted to cut hair longer and said second cutting head attachment being adapted to cut hair shorter.

* * * * *